US005439411A

United States Patent [19]

Griffin

[11] Patent Number: 5,439,411

[45] Date of Patent: Aug. 8, 1995

[54] SURFACE TREATING APPARATUS AND METHOD

[75] Inventor: Ellis Griffin, Brownwood, Tex.

[73] Assignees: Wayne Ward, Fort Worth; Carrol F. Shofner; Scott Ensor, both of Benbrook, all of Tex. ; a part interest to each

[21] Appl. No.: 160,925

[22] Filed: Dec. 1, 1993

[51] Int. Cl.[6] ..... B24C 3/00

[52] U.S. Cl. ..... 451/92; 451/99

[58] Field of Search ..... 51/429, 424, 425, 436, 51/410, 439; 451/92, 87, 88, 99, 75, 102, 100

[56] References Cited

U.S. PATENT DOCUMENTS 2,684,558 7/1954 Harris et al. ..... 51/429

3,906,673 9/1975 Goto et al. ..... 51/429

5,181,348 1/1993 Roemmele et al. ..... 51/429

*Primary Examiner*—Robert A. Rose

*Attorney, Agent, or Firm*—Arthur F. Zobal

[57] ABSTRACT

The apparatus has a lower manifold with a plurality of passageways each with an inlet and an outlet and an upper chamber has an inlet and a plurality of orifices leading to the plurality of passageways respectively between their inlets and outlets. A pressure tank having particulate media under pressure is provided with a main conduit coupled thereto. The main conduit splits into an air and media conduit portion which is coupled to the inlet of the upper chamber and an air conduit portion which extends upward for separating the air from the particulate media and then downward where it is coupled to the inlets of the passageways.

2 Claims, 3 Drawing Sheets

SURFACE TREATING APPARATUS AND METHOD

BACKGROUND OF THE INVENTION

1. Filed of the Invention

The invention relates to the cleaning or treating of surfaces such as floors with air and particulate media.

2. Description of the Prior Art

In the past, floors made from quarry, pavers, slate, granite, marble, ceramic, VA, concrete, etc. have been cleaned or restored with air and sand blasting systems or with chemicals. The typical air and sand blasting systems can ruin some floors and produce too much dust, etc. for indoor use and the chemical cleaners used are expensive and hazardous and pose considerable threat to the environment.

SUMMARY OF THE INVENTION

It is an object of the invention to provide a new and useful apparatus and method for cleaning and treating surfaces such as floors which does not use chemicals and which does not have the problems associated with conventional air and sand blasting systems.

The apparatus comprises a lower manifold with a plurality of passageways with each passageway having an inlet and an outlet, and an upper chamber with an inlet and a plurality of orifices leading to the plurality of passageways respectively between their inlets and outlets. A pressure tank is provided having particulate media under pressure. A main conduit is coupled to the pressure tank. The main conduit splits into an air and media conduit portion which is coupled to the inlet of the upper chamber and an air conduit portion which extends upward for separating the air from the particulate media and then downward where it is coupled to the inlets of the passageways.

In another aspect a skirt is provided having an outlet opening to be located next to the surface to be treated. A plurality of conduits are coupled from the outlets of the passageways to the interior of the skirt for conveying air and particulate media onto the surface to be treated. A vacuum device is coupled to the skirt for removing material including spent media dust and air from the interior of the skirt and resulting from the application of the particulate media onto the surface to be treated.

The method employs the apparatus for treating the surface.

DESCRIPTION OF THE PREFERRED EMBODIMENT

Figure 1:
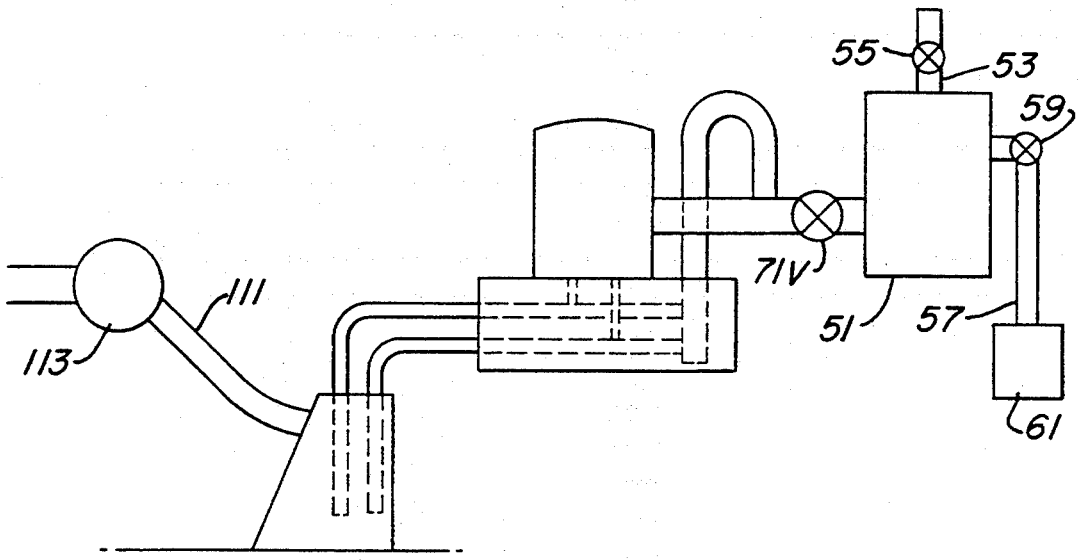
FIG. 1 is a schematic of the apparatus of the invention.
Figure 2:
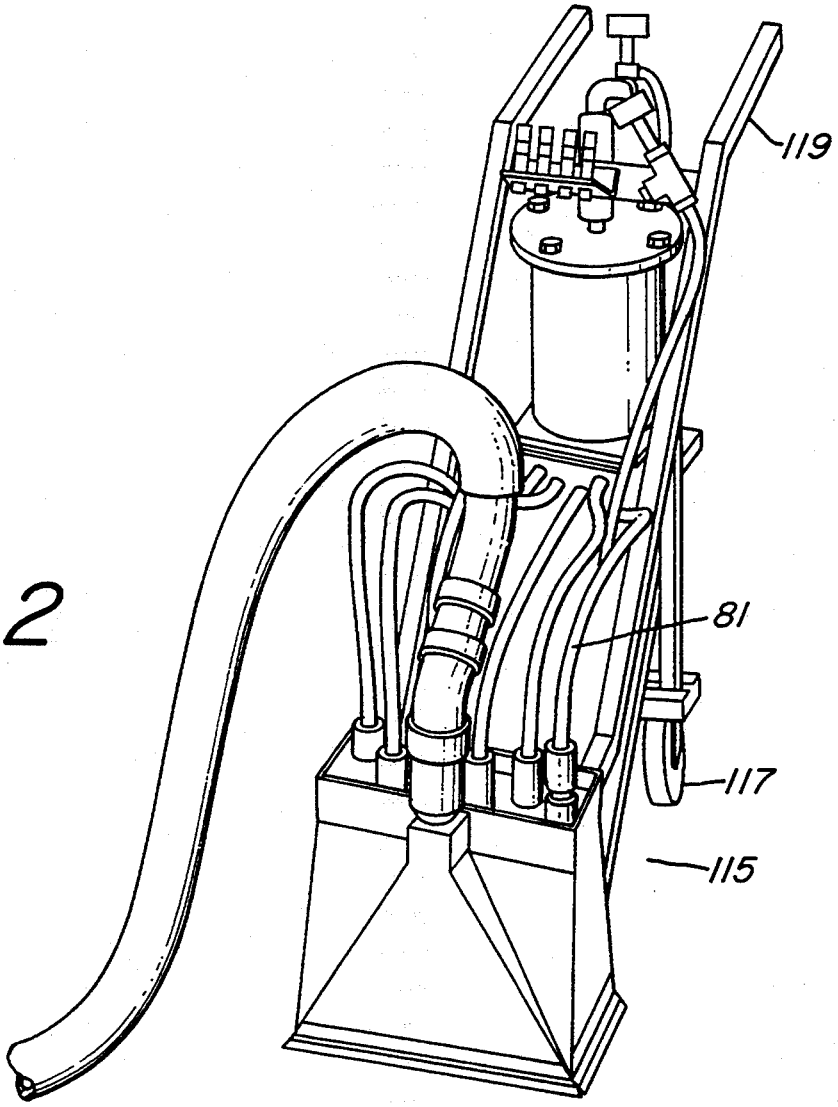
FIG. 2 is a isometric view of the apparatus of the invention.
Figure 3:
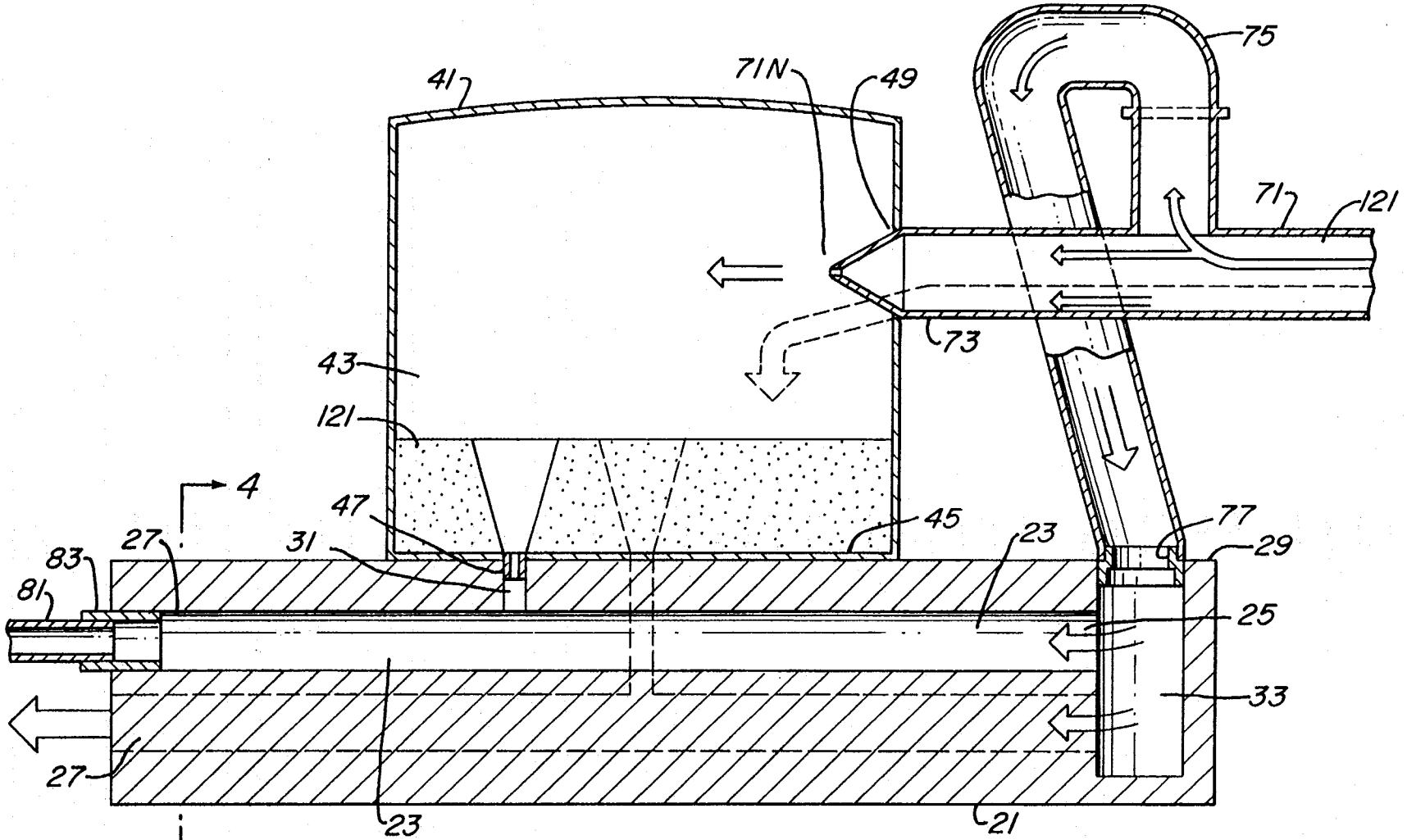
FIG. 3 is an enlarged cross sectional view of the chamber and manifold of FIGS. 1 and 2.
Figure 4:
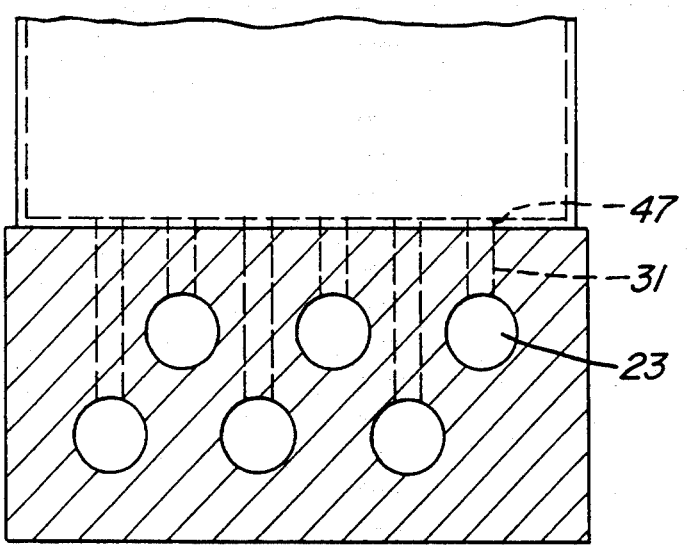
FIG. 4 is a cross sectional view of FIG. 3 taken along the lines 4—4 thereof.
Figure 5:
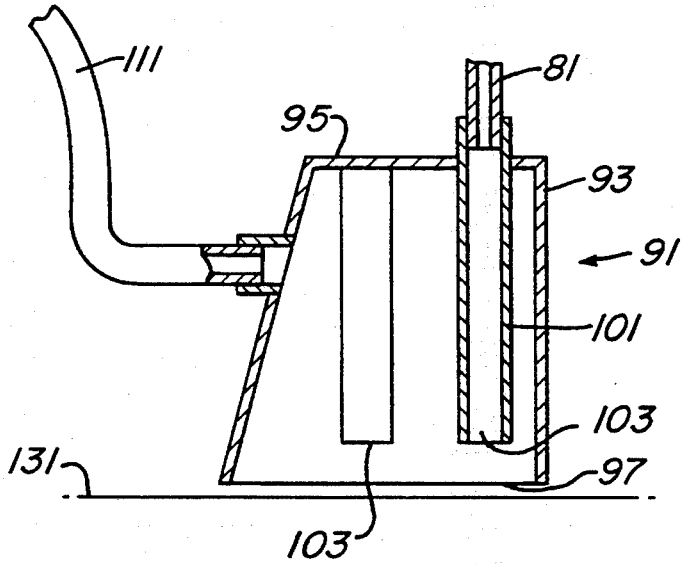
FIG. 5 is a cross sectional view of the skirt of FIGS. 1 and 2.

Referring now to the drawings, the apparatus comprises a lower manifold 21 having a plurality of passageways 23 with each passageway having an inlet 25 and an outlet 27. As shown in FIG. 5, the manifold 21 has six passageways 23 although it could have more or less. Extending from to top 29 of the manifold 21 to each passageway between its inlet and outlet is a smaller passageway 31. In addition an enlarged passageway 33 is formed in the manifold 21 in communication with each inlet 25. The cavity 33 extends to the top 29 of the manifold. A cylindrical chamber 41 having an interior cavity 43 and a bottom end 45 is coupled to the top 29 of the manifold 21. Located in the bottom 45 of the chamber 41 are six orifices 47. Each orifice 47 is secured to one of the passageways 31 for providing a flow path from the interior 43 of the chamber to each passageway 23. The chamber 41 has in inlet 49.

A pressure tank 51 is provided. The tank 51 has an inlet conduit 53 and a valve 55 for the insertion of particulate media and an inlet conduit 57 and a valve 59 for the application of air under pressure into the tank 51 from a source 61 of pressurized air.

A main flexible conduit 71 is coupled to the tank 51 and has a valve 71V for controlling flow into the conduit 71 from the tank 51. The conduit 51 has an air and media conduit portion 73 which is coupled to the inlet 49 of the chamber 41 and an air conduit 75 portion which is coupled to the cavity 33 by way of a coupling member 71.

Six conduits 81 are coupled to the outlets of the six passageways 23 by way of coupling members 83 and to the interior of a skirt 91. The skirt 91 has four side walls 93, a top wall 95 and a bottom opening 97. The end of each conduit 81 is coupled to the upper end of a conduit 101 which is coupled to the upper wall 95 and extends into the interior of the skirt 91. Each conduit 101 has an outlet opening 103 located near the skirt opening 97. Thus the six conduits 81 are coupled to six skirt conduits 101 supported by the skirt 91 and which extend to a position near the opening 97.

Coupled to one side wall 93 of the skirt 91 is a flexible hose 111 which is coupled to a vacuum device 113 which includes a vacuum blower for withdrawing spent media, dust and air out of the skirt 93.

The lower manifold 21 chamber 41 and skirt 91 are supported on an apparatus 115 which has wheels 115 and handle 119.

In operation, the tank 51 has particulate material or media inserted therein and is pressurized with air. The opening 97 of the skirt 93 is located next to the floor to be restored, cleaned, or etched and the valve 71V is opened. A mixture of particulate media 121 and air flow into the conduit 71 and then into the interior of the chamber 41 by way if outlet nozzle 71N. The chamber 41 becomes pressurized and the particulate media 121 drops by gravity to the bottom 45 of the chamber 41. The particulate media then pass into the passageway 23 by way of the orifices 47 and passageways 31.

The air conduit portion 75 extends upward and then downward whereby primarily air flows upward into the conduit 71 since the particulate media is separated from the air by gravity and drops back into the conduit 71 for passage through conduit portion 73. Air then flows from conduit portion 75 into the cavity 33 and then into the passageways 23 and forces the particulate media which has passed into the passageways 23 by way of the orifices 47, out of the passageways 23 into the conduits 81, 101 such that air and the particulate media flow through the conduit openings 103 onto the surface 131 to be treated. The spent media 121, dust and air are removed from the interior of the skirt 91 at an upper level by way of the conduit 111 and vacuum device 113.

The system thus provides a means for applying particulate media under pressure to a surface to be treated by way of a plurality of conduits all of which are enclosed by a skirt having a vacuum device to remove spent particulate media dust and air. The system is particularly useful in renewing and cleaning a ceramic floor by etching the top surface of the floor.

In one embodiment for etching purposes the particulate media may be granite of a particle size of about 30–40 mesh, having a MOH hardness of 7 to 8. The pressure tank 51 may be pressurized to 300 psi. The pressure in the chamber 41 may be 100 psi and the pressure at the nozzles 47 may be 60 psi. The diameters of the nozzles 47 may be ¼ to 5/16 of an inch. The diameters of the passageways 23 may be one inch; the inside diameters of the conduits 81 may be ½ inch; and the inside diameters of the conduits 101 may be 2 inches. The invention also may be used to clean surfaces such as carpets, painted metals, stainless steel, quarry, pavers, slat granite, marble, etc. For cleaning purposes, particularly for cleaning carpets, the media may be powdered baking soda or ground walnut hulls, corn cobs, or plastic material with the walnut hulls, corn cobs and plastic material ground to a mesh size of about 30–40. Sand or ground copper slag may be used for hard surfaces, tile, etc. . The copper slag may have a mesh size of about 80–25 and the sand may have a mesh size of about 30–40.

The skirt 91 may be separated from the unit 115 to clean elevated surfaces.

The following charts give specific information of the particulate media and use and the pressure.

1. MEDIA

Safety Etch—Granite M.O.H. harness 7 to 8

B.S. 24 (Baking Soda) for cleaning only—no reclaimable

Plastic (ground)—for cleaning—reclaimable

Copper Slag (ground)—for cleaning and etching M.O.H. 6.5 to 7.5

Sand—for cleaning—none reclaimable

| 2. PRESSURE | |
|---|---|
| Air pressure for etching | 100 p.s.i. at unit |
| | 60 p.s.i. at nozzle |
| Baking Soda - cleaning | 100 p.s.i. at unit |
| | 60 p.s.i. at nozzle |
| Plastic | 80 p.s.i. at unit |
| | 40 p.s.i. at nozzle |
| Copper Slag | 80 p.s.i. at unit |
| | 40 p.s.i. at nozzle |
| Sand | 100 p.s.i. at unit |

-continued

| 2. PRESSURE | |
|---|---|
| | 60 p.s.i at nozzle |

3. DIAMETER OF NOZZLES

¼" and 5/16"

I claim:

1. Apparatus the treating a surface, comprising:

a manifold having a plurality of passageways, each passageway having an air inlet, an air and particulate media outlet and a particulate media inlet intermediate said air inlet and said air and particulate media outlet, an upper chamber having an inlet and a plurality of orifice outlets equal in number to the number of said passageways, each of said orifice outlets being coupled to one of said particulate media inlets, a pressure chamber for containing air under pressure and particulate media, a main conduit coupled to said pressure chamber for receiving air and particulate media from said pressure chamber, said main conduit having an air and particulate media conduit portion with a first outlet and a second outlet upstream of said first outlet with an air conduit portion coupled to said second outlet, said first outlet of said air and particulate media conduit portion being coupled to said upper chamber for injecting air and particulate media into said upper chamber to allow said particulate media to drop to the bottom of said upper chamber by gravity for passage into said passageways by way of said orifice outlets and said particulate media inlets, said air conduit portion having an outlet coupled to said air inlets of said passageways for injecting air and particulate under pressure through said outlets of said passageways, said air conduit portion extending upward from said second outlet of said main conduit for separating air from said particulate media and then downward for conveying air to said inlets of said passageways.

2. The apparatus of claim 1, comprising:

a skirt having a cavity with an opening to be located next to the surface to be treated, a plurality of conduits coupled from said outlets of said manifold to said cavity of said skirt for conveying air and media into said cavity and onto the surface to be treated by way of said opening, and vacuum means coupled to said skirt at a portion spaced from said opening to remove material from said cavity of said skirt and resulting from application of said particulate media onto the surface to be treated.

* * * * *